United States Patent [19]

Lindqvist

[11] 4,181,343

[45] Jan. 1, 1980

[54] OSCILLATING MOVEMENT DAMPING MEANS INTENDED FOR PIVOTALLY SUSPENDED HOISTING GEAR

[76] Inventor: Jonas H. Lindqvist, Hudiksvall, Sweden

[73] Assignee: Hiab-Foco, Aktiebolag, Sweden

[21] Appl. No.: 874,623

[22] Filed: Feb. 2, 1978

[30] Foreign Application Priority Data

Feb. 17, 1977 [SE] Sweden ..... 7701750

[51] Int. Cl.[2] ..... B66C 1/00

[52] U.S. Cl. ..... 294/86 R; 294/88

[58] Field of Search ..... 294/86 R, 106, 82, 70, 294/88 R; 308/237 R, 163, 237 R, DIG. 9; 188/306, 1 B; 280/432, 406; 214/147 G, 651, 652, 656, 657

[56] References Cited

U.S. PATENT DOCUMENTS

| | | | |
|---|---|---|---|
| 3,592,503 | 7/1971 | Landberg | 294/86 R |
| 4,099,761 | 7/1978 | Cullings | 294/86 R |

*Primary Examiner*—James B. Marbert

*Attorney, Agent, or Firm*—Newton, Hopkins & Ormsby

[57] ABSTRACT

A means to damp the oscillating movements of a hoisting device suspended in a link the upper end of which is in the form of a cylinder in which is pivotally mounted a first horizontal shaft on the outer end of a crane jib and the lower end of which is in the form of a fork member supporting between its legs a second horizontal shaft in a second cylinder forming the upper end of a holder supporting the hoisting device. The damping is affected by spring-actuated brake shoes acting against its respective cylinder face. Rotationally mounted clamp bolts are arranged when turned, preferably over 180°, to increase the tension of said spring means.

8 Claims, 4 Drawing Figures

OSCILLATING MOVEMENT DAMPING MEANS INTENDED FOR PIVOTALLY SUSPENDED HOISTING GEAR

BACKGROUND OF THE INVENTION

The present invention concerns an improved means intended to damp the oscillating movements of hoisting gear suspended in a link, the upper end of which is pivotally mounted about a first horizontal shaft on the outer end of e.g. a crane jib and at the lower end of which the hoisting gear is pivotally mounted about a second horizontal shaft, the vertical longitudinal medium plane of which forms an angle, preferably a right angle, to the vertical longitudinal medium plane of the first shaft.

The hoisting device may be in the form of e.g. a gripping means the gripping jaws of which, when spread apart, are intended to grab a number of logs in a log pile and lift them onto a loading vehicle. Such hoisting gear, when freely suspended, will however easily start oscillating during the crane jib operations. Also when the crane jib movements have ceased, the hoisting gear continues to oscillate. The oscillation or pendulum system possesses such inertia that it takes considerable time before the oscillations die away, which considerably delays the work.

Various solutions have been suggested to diminish the oscillating time. In accordance with one suggestion telescopic shock absorbers are inserted between the crane jib and the hoisting device. However, shock absorbers are liable to damage during loading operations. In addition, they considerably restrict the angular deflections or swings of the hoisting device.

In accordance with another suggested solution the link joints are provided with a friction lining, e.g. in the form of rubber bushings provided at the link hub. The rubber is prestressed through axial compression. One disadvantage of this type of damper means is that the compression pressure must be reset from time to time. Because the damper means is arranged about the rotational shafts of the link, the frictional force will act with a comparatively small leverage to the centre of rotation. The braking moment consequently will be relatively small. In addition, the angular speed of the pendulum will be low. The damper acts close to the area of static friction, which results in considerable wear.

According to yet another suggested solution the link in which the hoisting device is suspended, is provided with a sector-shaped brake disc having its centre in or close to the centre of the upper articulation shaft and the crane jib is provided with at least one brake shoe arranged through the action of a spring to be pressed against the brake disc at a distance from said shaft. Although the resulting damping effect is extremely good as a result of the positioning of the brake shoe comparatively far from the articulation shaft, the disadvantage is that the pendulum device becomes large and bulky and therefore also is easily exposed to damage during operation.

SUMMARY OF THE INVENTION

The subject invention has for its purpose to remedy the drawbacks outlined above.

The invention is characterised in that at its upper part the link is provided with a first hub in the form of a partial cylinder, a first brake shoe being provided to press against the cylindrical face of said hub in a manner known per se through the action of a first spring means, that the brake shoe together with the first spring means are housed in a first fork member or the like supporting the first horizontal shaft, that the lower link end is in the form of a second fork member the legs of which support the second horizontal shaft and that a second hub in the form of a partial cylinder is journalled on said second shaft between the second fork member legs, said second hub positioned on the upper end of a holder means arranged to suspend the operative tool (hoisting device) and that a second brake shoe is arranged for displacement between the fork legs of the link, which second brake shoe is arranged to be pressed against the cylindrical face of the second hub in a manner known per se through the action of a second spring means.

When a brake shoe is allowed to exert its action against the jacket face of the enlarged link hub as in the present case, it works at a large distance away from the shaft and yet the brake disc need not be given the large dimensions required when lateral brake shoes are employed. Nor are two oppositely positioned and interacting brake shoes required to balance the forces emanating from the springs compressing the brake shoe or brake shoes against the disc. The advantages gained by the oscillating movement damper in accordance with the subject invention resides in the highly satisfactory braking effect it provides in spite of the reduced height of the structure. The damper in accordance with the invention can be given reduced dimensions, it is easy to mount for exchange of tools and it needs practically no maintenance. There are no projecting components that could be damaged during the loading operations.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 2:
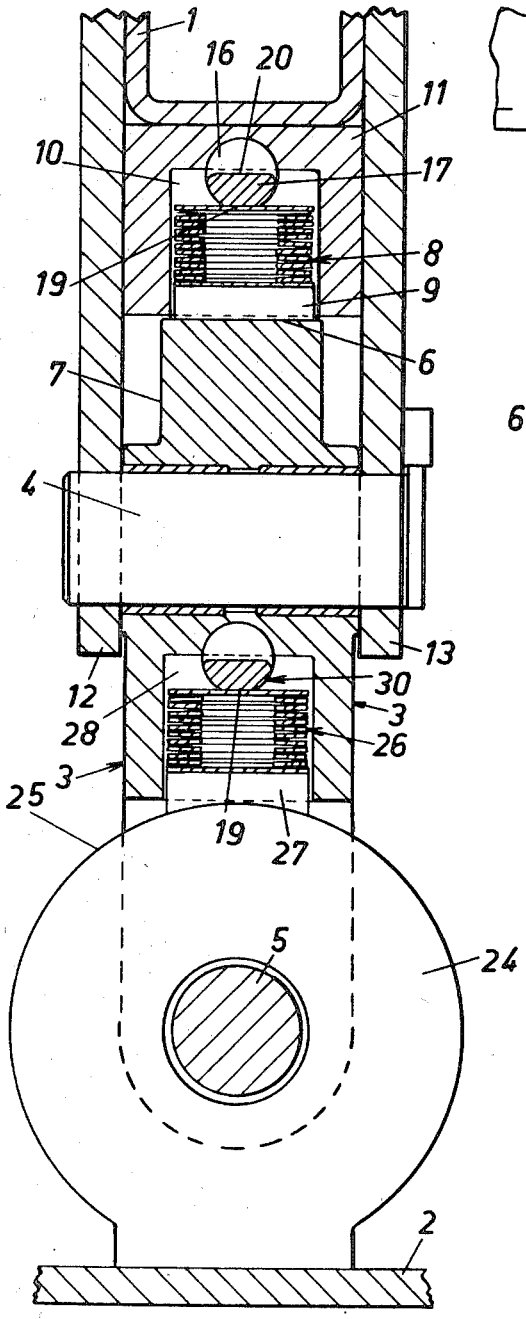
FIG. 2 is a vertical longitudinal sectional view along line II—II of FIG. 1.
Figure 1:
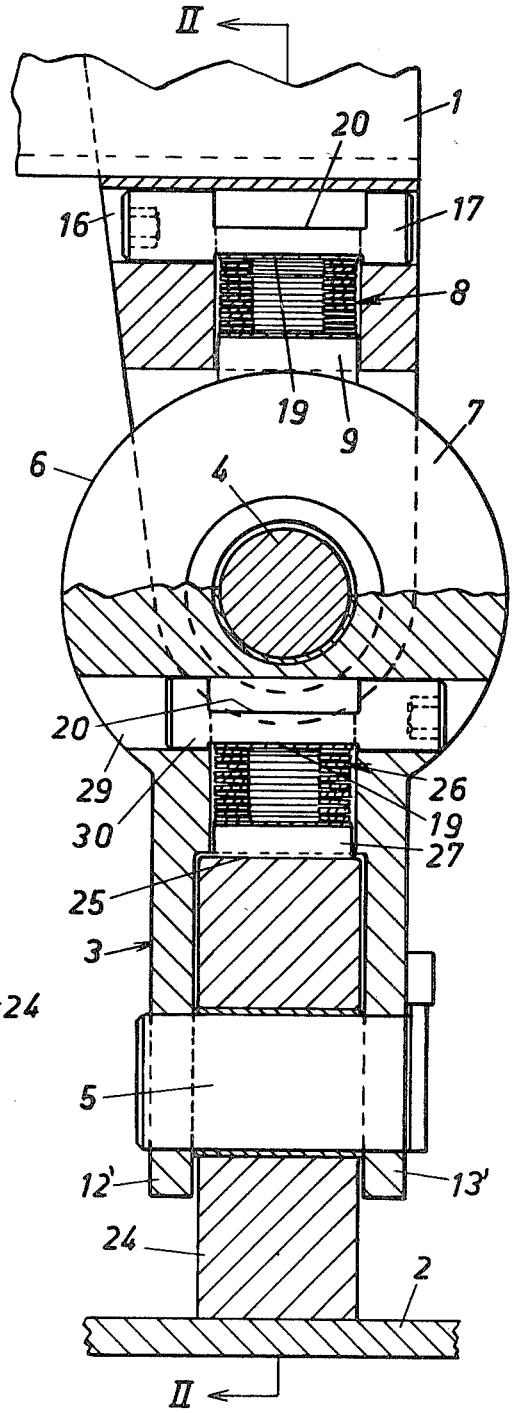
FIG. 1 is a partly vertical sectional view through an oscillating movement damper in accordance with the invention.

FIGS. 1 and 2 illustrate the outer end of a crane jib 1 which is mounted for swinging movements in various directions upwards and downwards as well as in the lateral directions. The upper end of a holder 2 supporting a hoisting device, such as e.g. a gripping means (not shown), is by means of a link 3 articulated to the crane jib 1. A horizontal shaft 4 journals the upper end of the link 3 to the crane jib 1, and a second horizontal shaft 5, positioned in a different vertical plane from the shaft 4, journals the link to the holder 2. These two shafts 4, 5 form a cardanic suspension such that the lifting device and its holder 2 may pivot and swing in various directions. An oscillating movement damper in accordance with the subject invention is provided on each articulation shaft.

The upper oscillating movement damper includes the outer jacket face 6 of the enlarged hub 7 of the link 3. By the action of a spring means 8 a brake shoe 9 is pressed against the jacket face 6, said brake shoe 9 being axially displaceable in a bore 10 in a fork member 11 which is secured to the crane jib 1 and the legs 12, 13 of which support the shaft 4 at their lower ends. The spring means 8 consists of a stack of alternatingly facing cup springs, i.e. cup-shaped steel washers 14, 15, which are housed in the bore 10. In a transversely extending bore 16 in the fork member 11 is inserted a tensioning or clamp bolt 17 one end of which is formed with a hexagonal recess 18 into which a key may be introduced to turn the bolt 17. At its centre, the bolt 17 is provided with two elongated flat faces 19, 20 at different distances 21 and 22 from the longitudinal axis 23 of the bolt. These faces 19, 20 of the bolt 17 abut against a support washer 14' positioned at the top of the spring means 8.

Figure 3:
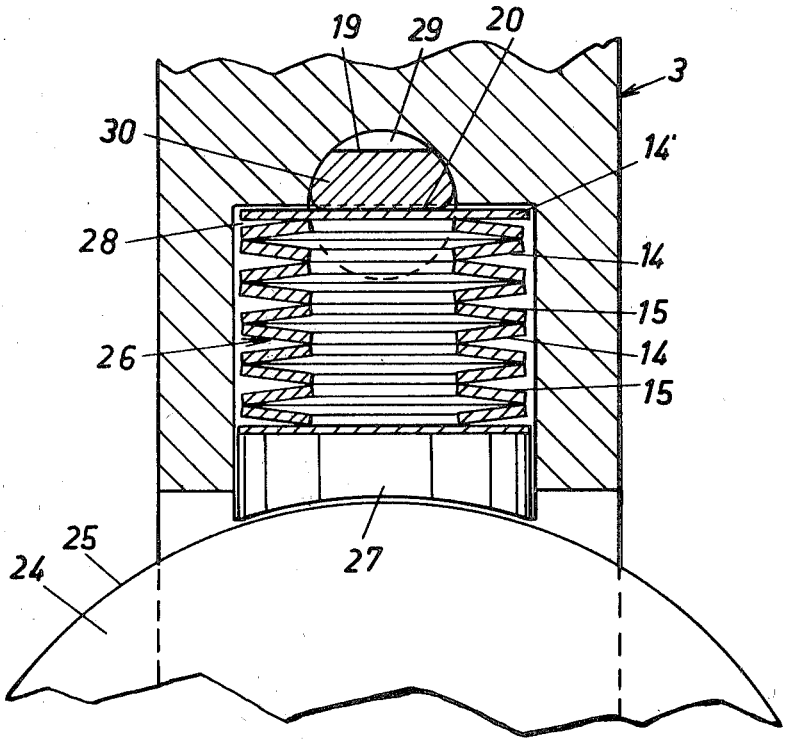
FIG. 3 illustrates on an enlarged scale the lower part of the link shown in FIG. 2, the spring means being in its neutral or relaxed position.
Figure 4:
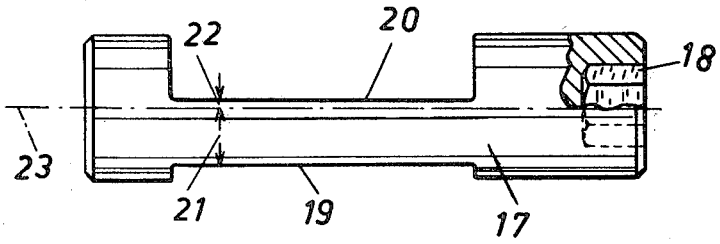
FIG. 4 illustrates, on the same scale, a lateral view of a clamp bolt designed to compress the spring means.

The lower oscillating movement damper (FIG. 3) agrees constructively with the upper damper just described. The upper part of the holder 2 is formed into a hub 24 having a cylindrical jacket face 25, said hub arranged to be positioned between the legs 12' and 13' of the fork-like lower end of the link 3 and to turn about the shaft 5. A brake shoe 27, which is axially displaceable in a bore 28 in the link 3 below the shaft 4, may be pressed against the jacket face of the hub through the action of a spring means 26. In a transverse bore 29 in the link 3 may be introduced a clamp or tensioning bolt 30 of identical configuration to bolt 17 illustrated in FIG. 4.

Considerable advantages are gained, both from a functional and a maintenance point of view, by using spring means 8, 26 composed of cup springs assembled into a stack. Cup springs have almost linear elasticity properties and they retain these properties over the entire spring-affected path of the brake shoes 9, 27, until the latter are worn out. As a result, the braking moment is practically constant until the brake shoes are worn out. Consequently, later re-tensioning of the springs is not necessary as a rule.

The oscillating movement damping means is assembled in the following manner. The clamp bolt 17 is introduced axially into its associated bore 16. The cup springs 14, 15 as well as the brake shoe 9 are inserted into the bore 10. The link 3 is positioned between the legs 12, 13 and the shaft 4 is passed through the leg 13, the hub 7 and the leg 12. To make this possible, the clamp bolt 17 must be turned to the position illustrated in FIG. 3, wherein the support washer 14' abuts against the flat surface 20, i.e. the cup springs 14, 15 are in their relaxed or unbiased position. After completion of the assembly, the clamp bolt 17 is turned over half a revolution, whereby the flat surface 19 will face the support washer 14'. In this position, the cup springs 14, 15 are compressed and the brake shoe 9 is forced hard against the cylindrical face 6. The damping effect therefore will be considerable.

Owing to the upwardly directed reactional pressure from the spring means 8 which acts against a flat surface 19 on the clamp bolt 17, a self-retaining effect is obtained, i.e. there is no tendency whatsoever that the clamp bolt will be unadvertently turned back to the original position.

The lower oscillating movement damper is assembled in the same manner.

The embodiment as shown and described is to be regarded as an example only and the various components and details of the oscillating movement damper may be constructively altered in a variety of ways within the scope of the appended claims. For instance, another tensioning or clamping means could replace clamp bolt 17 to compress the spring means 8 and 26. The cup springs 14, 15 could be exchanged for other types of spring means. The oscillating movement damper in accordance with the invention could be used in other fields of application than the one described above.

What I claim is:

1. An improved oscillating movement damping means for a hoisting device, comprising a link in which said hoisting device is suspended, a first horizontal shaft pivotally mounting the upper end of said link to the outer end of a lifting means, such as a crane jib, a second horizontal shaft pivotally mounting said hoisting device to the lower end of said link, the vertical longitudinal medium plane of said second shaft forming an angle, preferably a right angle, to the vertical longitudinal medium plane of said first shaft, the improvement comprising a first hub in the form of a partial cylinder provided at the upper part of said link, a first brake shoe arranged to press against the cylindrical face of said first hub in a manner known per se through the action of a first spring means, a first fork member supporting said first horizontal shaft housing said first brake shoe and said first spring means, a second fork member forming the lower end of said link, the legs of said second fork member supporting said second horizontal shaft, a second hub in form of a partial cylinder being journalled on said second shaft between the legs of said second fork member, a holder means arranged to suspend said hoisting device, said second hub positioned on the upper end of said holder means, and a second brake shoe arranged for displacement between the fork legs of said link, said brake shoe arranged to be pressed against the cylindrical face of said second hub in a manner known per se through the action of a second spring means.

2. An improved oscillating movement damping means as claimed in claim 1, comprising a first horizontal clamp bolt rotatably mounted in said first fork member supporting said first horizontal shaft, said clamping bolt arranged, when turned, preferably over 180°, to increase the tension of said first spring means.

3. An improved oscillating movement damping means as claimed in claim 1, comprising a number of alternatingly facing cup springs, assembled into a stack, forming said first and said second spring means, said cup springs consisting of cup-shaped steel washers having essentially linear elasticity properties.

4. An improved oscillating movement damping means as claimed in claim 1, comprising a second horizontal clamp bolt similar to said first clamp bolt and rotatably mounted in said link, said second clamp bolt arranged, when turned, to increase the tension of said second spring means.

5. An improved oscillating movement damping means as claimed in claim 2, comprising a first flat area in the centre portion of said first clamp bolt, said first flat area positioned eccentrically relatively the mounting ends of said bolt, the end of said first spring means remote from said first brake shoe abutting against said first flat area in said first clamp bolt.

6. An improved oscillating movement damping means as claimed in claim 5, comprising a second flat area in said first clamp bolt, said second flat area positioned opposite said first flat area and spaced a shorter distance from the longitudinal axis of said first clamp bolt.

7. An improved oscillating movement damping means as claimed in claim 4, comprising a first flat area in the centre portion of said second clamp bolt, said first flat area positioned eccentrically relatively the mounting ends of said second clamp bolt, the end of said second spring means remote from said second brake shoe abutting against said first flat area in said second clamp bolt.

8. An improved oscillating movement damping means as claimed in claim 7, comprising a second flat area in said second clamp bolt, said second flat area positioned opposite said first flat area in said second clamp bolt and spaced a shorter distance from the longitudinal axis of said second clamp bolt.

* * * * *